United States Patent [19]

Luebke

[11] 4,388,357

[45] Jun. 14, 1983

[54] SHEET USEFUL AS A RESERVOIR LINER

[75] Inventor: Robert W. Luebke, Hudson, Ohio

[73] Assignee: True Temper Corporation, Cleveland, Ohio

[21] Appl. No.: 273,403

[22] Filed: Jun. 15, 1981

Related U.S. Application Data

[62] Division of Ser. No. 5,699, Jan. 23, 1979, Pat. No. 4,296,884.

[51] Int. Cl.[3] ..... B32B 25/10; B65G 5/00; E02B 5/02; E21F 17/16

[52] U.S. Cl. ..... 428/57; 210/170; 238/1; 405/36; 405/53; 428/190; 428/213; 428/215; 428/286; 428/290; 428/311.1; 428/319.3

[58] Field of Search ..... 428/57, 190, 286, 290, 428/483, 213, 215, 337, 317, 321, 322; 405/270, 36, 53; 238/1; 210/170

[56] References Cited

U.S. PATENT DOCUMENTS

| | | | |
|---|---|---|---|
| 219,182 | 9/1879 | Slearns | 428/57 |
| 2,624,886 | 1/1953 | Herman | 428/57 |
| 3,949,113 | 4/1976 | Draper et al. | 428/57 |
| 4,065,924 | 1/1978 | Young | 428/703 |
| 4,184,786 | 1/1980 | Richards | 428/255 |
| 4,296,884 | 10/1981 | Luebke | 210/170 |
| 4,299,697 | 11/1981 | Curati | 210/532.1 |

*Primary Examiner*—James C. Cannon

*Attorney, Agent, or Firm*—Baldwin, Egan, Walling & Fetzer

[57] ABSTRACT

A containment reservoir for a liquid, such as petroleum oil, comprising, a walled ground containment space or pit, opening upwardly, with the space containing a liquid impervious flexible liner generally following the contour of the space, and with the liner comprising a layer of pervious fabric material having on at least one of its sides a layer of liquid impervious material, such as rubber, the liner being operable to prevent escape of liquid through the liner from the containment space; means are provided coacting with the liner covered containment space for removing liquid from the reservoir. A covering layer of pervious fabric material filters anything, including liquid, passing into the reservoir. A method of forming the reservoir from predetermined width strips of liner stock, and a method of retaining and salvaging oil spilled along a railroad track environment is also disclosed.

4 Claims, 7 Drawing Figures

SHEET USEFUL AS A RESERVOIR LINER

This is a division of application Ser. No. 5,699, filed Jan. 23, 1979, now U.S. Pat. No. 4,296,884.

This invention relates in general to reservoirs and more particularly to a containment reservoir formed by lining an earthen containment space or pit with a liquid impervious liner, with the liner comprising a layer of pervious fabric material and a layer of liquid impervious material, with the liner being operable to retain received liquid in the containment space.

BACKGROUND OF THE INVENTION

Reservoirs formed with a flexible liner layed in or lining an earthen containment space, or lining a tank, are well known in the art. U.S. Pat. Nos. 3,872,007, 3,474,625 and 1,081,515 disclose various arrangements of formed reservoirs utilizing a flexible liner. However, these prior art reservoirs generally provide for the liner being a one piece affair, defining the entire containment space or reservoir, and have not been entirely satisfactory. Moreover, to applicant's knowledge, no one heretofore has provided a containment reservoir utilizing a flexible liner material, and having a covering layer of pervious fabric material overlying the opening into the reservoir, for filtering liquid passing into the reservoir, and as is disclosed in applicant's invention.

SUMMARY OF THE INVENTION

The present invention provides a containment reservoir and a method of forming the same, for liquids such as petroleum oils, and which can be expeditiously made in any size desired, with the reservoir being formable in an earthen space or pit by a liquid impervious liner generally following the contour of the earthen reservoir, and with the liner comprising a layer of pervious fabric material having on at least one of its sides a layer of impervious material such as rubber, with such liner being operable to resist or prevent escape of liquids from the containment space. The invention also provides a method of forming the reservoir from liner strip stock material, and a method of retaining and salvaging spilled oil along a railroad track environment, as well as a petroleum resistant liner for an earthen reservoir.

Accordingly, an object of the invention is to provide a novel containment reservoir for liquids, such as petroleum based oils.

A further object of the invention is to provide a reservoir of the above type in which the containment space has a liquid impervious liner generally following the contour thereof in at leaat one direction and with the liner comprising a layer of pervious fabric material and a layer of impervious material, such as rubber, with the impervious layer facing outwardly of the space, and with the liner being operable to resist escape of liquids from the space, through the liner.

A further object of the invention is to provide a reservoir in accordance with the above wherein the liner comprises a non-woven polyester fabric material layer having a rubber coating bonded or secured to one side of the pervious layer, and forming the impervious layer of the liner.

A still further object of the invention is to provide a reservoir of the latter type which includes means coacting with the liner covered containment reservoir for removing liquid from the reservoir.

A still further object of the invention is to provide a containment reservoir of the above described type wherein the liner is comprised of a plurality of strip sections, each of predetermined width, with the strip sections being joined at the junctures thereof, and forming the liner for the reservoir.

A still further object of the invention is to provide a reservoir of the above described type in combination with a railroad track system which includes longitudinally extending rails and transversely extending ties supporting the rails, with the containment space having a layer of ballast material disposed therein, with the ties being supported on the ballast material, and having a layer of non-woven pervious fabric material covering the containment space and resting on the top of the ballast material, which pervious layer permits the passage of and filters liquid therethrough to be received in the lined reservoir.

A still further object of the invention is to provide a method of forming or fabricating a lined earthen reservoir.

Another object of the invention is to provide a method of retaining and salvaging oil which is inadvertently spilled along a railroad environment, to prevent its contaminating the adjacent soil areas.

Other objects and advantages of the invention will be apparent from the following description taken in conjunction with the accompanying drawings wherein:

DESCRIPTION OF PREFERRED EMBODIMENTS

Figures 1, 2, 3, 4, 5, 7:
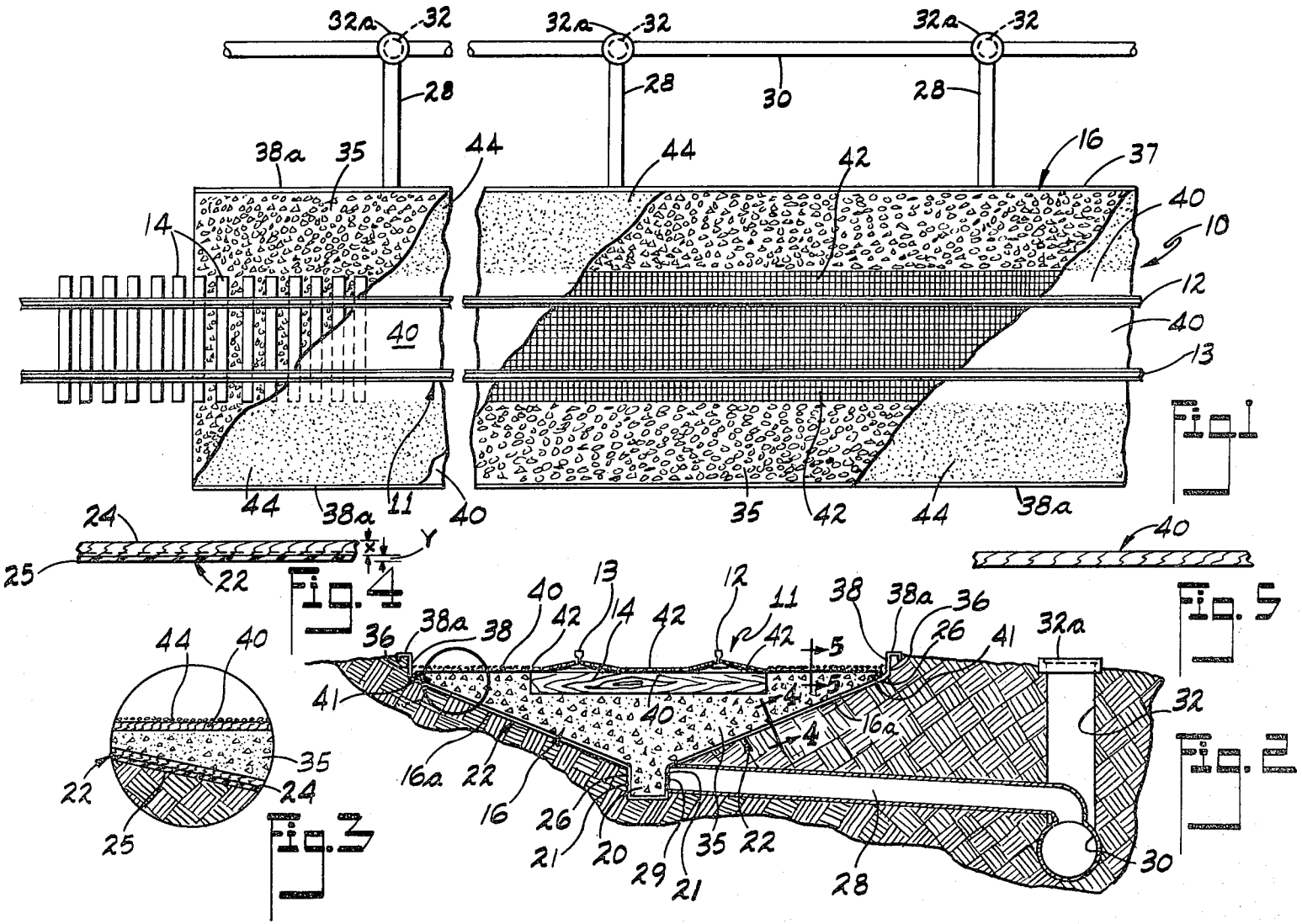
FIG. 1 is a top plan, broken, fragmentary view of a reservoir in combination with a railroad track section, for containing liquids, such as petroleum based oil, that is inadvertently spilled from vehicles on the railroad track section, or during fueling of such vehicles, so as to prevent the seepage of the oil into the soil areas adjacent the track section, and to retain it in a reservoir disposed beneath the track section, for subsequent salvage.
FIG. 2 is a vertical transverse sectional view of the lined reservoir of FIG. 1.
FIG. 3 is an enlarged view of a section of the top portion of the reservoir of the FIGS. 1 and 2, illustrating details of the structure.
FIG. 4 is an enlarged, vertical sectional view of the liquid impervious liner utilized in the reservoir of FIGS. 1–3, and is taken generally along line 4—4 of FIG. 2, looking in the direction of the arrows.
FIG. 5 is an enlarged, vertical sectional view taken generally along the plane of line 5—5 of FIG. 2, looking in the direction of the arrows, and illustrating the pervious layer of fabric material overlying the open top of the reservoir of FIGS. 1–3.
FIG. 7 is an enlarged, transverse sectional view of the reservoir of FIG. 6.

Referring now to FIGS. 1 through 5, there is illustrated the combination of a containment reservoir 10 formed in accordance with the invention, and a railroad track section 11. The railroad track section comprises spaced rails 12 and 13 which are supported in the conventional manner on ties 14 which in this case, are shown as wood ties 14. However, any suitable type of tie structure, including concrete ties may be used. The railroad track section 11 is adapted to carry conventional railroad equipment including diesel powered locomotives. Containment reservoir 10 formed in accordance with the invention extends beneath and laterally of track section 11. Reservoir 10 comprises a space or pit 16 in the ground, opening upwardly and encompassing the railroad track section 11 for a predetermined portion of the length thereof. The walls of the containment space 16 in the embodiment illustrated, are sloping downwardly and inwardly (FIG. 2) so that any liquid in the reservoir drains downwardly toward a central drain area 20 of the space, the latter area preferably comprising generally vertically oriented walls 21 which merge with the diagonal defining side wall surfaces 16*a* of the space 16.

In accordance with the invention, the walls of space 16 are covered with a liner 22 so as to restrict or prevent escape of liquid from the containment space into the surrounding ground area. The liner comprises a layer 24 (FIGS. 3 and 4) of pervious fabric material, such as for instance a non-woven polyester fabric. A preferred fabric material is known in the trade as "Bidim" engineering fabric manufactured by Monsanto Textile Company of St. Louis, Mo. This "Bidim" fabric is a random entanglement of polyester filaments, and is of relatively low fabric density, which enables liquids to pass completely through the "Bidim" layer. The "Bidim" fabric is manufactured by needle punching of direct spun polyester filaments which may be continuous filaments. The fabric has nearly the same tensile strength in all directions and therefore withstands large local deformation, and possesses excellent puncture resistance, while still being of a highly porous nature. The fabric will generally retain or hold back particles larger than about 70 microns, while permitting smaller liquid-borne fines to pass through without clogging the fabric. Moreover, there is negligible change in the physical properties of the "Bidim" fabric from below zero temperatures to temperatures as high as 400° F. The "Bidim" conventionally comes in various standard widths in roll form, such as for instance 13 ft. 6 in. wide, or approximately 17 ft. 4 in. wide. Fabric layer 24 may be anywhere from approximately 60 to 190 mils in thickness.

The liner 22 also comprises a layer 25 of material impervious to liquid, such as rubber, with the impervious layer in the embodiment illustrated in FIGS. 1–3, facing outwardly of the containment space. The impervious layer 25 can be applied to the layer of pervious fabric material by conventional calendering processes, known in the rubber art, resulting in a liner which while highly flexible, is impervious to the flow of liquid therethrough. The thickness y of the impervious layer 25 may be approximately one-third the thickness x of the pervious layer 24. However, 6–10 mils of rubber also impregnates into the pervious layer and thus is securely fastened or bonded thereto. The rubber is preferably resistant to oil degradation (e.g. Nitrile Rubber). The rubber is calendered onto strips of the fabric of predetermined width (e.g. 60 inches) and length (approximately 984 feet) and then such rubber coated fabric strips are fastened togethr or joined by conventional adhesive means, and cured, and then cut, to form a predetermined width and length of coated fabric stock (e.g. 19 feet wide × 100 feet long) which is subsequently packaged for transportation to and use at the site where the reservoir is to be installed.

The liner may be laid down in strip form as aforementioned, from rolls of liner stock material, and with the strips being preferably overlapped as at 26 (FIG. 7) for providing a lined containment reservoir of any desired size. The overlapping preferably occurs in a downward direction as illustrated, and preferably on oblique or vertical portions of the containment space. The overlapped sections of the coated fabric are preferably secured together by suitable and known adhesive means, which can be applied at the site, so that there is no change for liquid to seep between the juncture portions and escape from the reservoir into the surrounding ground area.

Leading from the drain portion 20 of the containment reservoir is at least one passageway 28 (a plurality of such passageways being illustrated in FIG. 1) for draining the reservoir. Such passageways communicate through the liquid impervious liner as by means of ports or puncture openings 29 (FIG. 2) in the liner and passageway 28 preferably slopes downwardly toward a transversely extending larger further passageway 30 running generally parallel (FIG. 1) to the reservoir and associated track section 11. Passageways 28 and 30 are preferably lined as by means of tile or concrete or any other suitable material, for preventing the liquid received from the containment reservoir from passing or seeping into the surrounding ground areas.

Communicating with passageway 30 are vertical shafts 32, providing access to the passageway 30, with such shafts being preferably covered by manhole covers 32*a*. It will be seen that upon removal of the covers 32*a*, access is provided to the shafts 32 opening or communicating via an opening in the top of passageway 30, with the respective shaft 32. Liquid that is caught in the reservoir 10 will drain by gravity down through drain section 20, down passageway 28 into passageway 30, where it may be removed by gravity flow to a more remote location or a storage facility (not shown). Passageways 32 provide access to drain passageways 28 and 30 for clean out purposes.

The containment space 16 is filled with a lump-like material of relative large or coarse size, such as railway bed ballast 35, comprising stones or the like conventionally utilized in conjunction with a railroad track installation. Such ballast bed 35 has very little if any, fines, to prevent clogging of the bed. Such highly porous layer or bed 35 of ballast will readily pass therethrough liquid caught by the reservoir. The space 16 is of sufficient depth to preferably provide a minimum of 8 inches depth of ballast layers beneath ties 14.

It will be seen that the upper end of the reservoir on its sides is preferably defined in part by generally vertical earthen side wall sections 36, which are covered by sections 38 of the liner material. Such upper wall sections 38 of the liner preferably extend horizontally as at 38*a* for a predetermined width, and then are retained in position as by means of the adjacent soil, to hold the respective upper end wall liner section 38 in position. It will be understood of course that means other than abutting soil could be provided for anchoring or holding the upper sections of the liner in place. The portion of liner 22 in the containment or pit area, is positively maintained in position by the weight of the ballast supported on the liner, but since the liner is of puncture resistant material as aforementioned, such ballast does not injure the liner.

In this embodiment of reservoir, the ties 14 are embedded in the ballast in the conventional manner of supporting railroad ties, and thus are held in predetermined position and support the track members 12 and 13 thereon.

In order to filter liquid, such as fuel and/or lubricating oils that may drip down from the diesel locomotives or other vehicles on track section 11, prior to the liquid passing into the containment space, and to prevent plugging of the porous ballast layer 35, the top of the reservoir is preferably covered by a layer 40 of flexible pervious fabric material, such as the aforementioned "Bidim" fabric, with said upper layer 40 extending from the aforedescribed upper sections 38 of the liner 22, to the respective rail members 12 or 13, as well as across the space intermediate the rail members 12 and 13. As best shown in FIG. 2, layer 40 may be tucked inwardly and downwardly as at 41, adjacent liner sections 38.

In order to maintain the top pervious layer of fabric material in place covering the top of the reservoir, the strip of material intermediate the track or rail members 12 and 13, and on either side thereof for a predetermined distance outwardly therefrom, are weighted down by preferably metal grating 42, which is preferably of articulated construction, and which hold the sections of pervious filter layer material 40 in position covering the top end of the reservoir. Laterally outwardly from the grating sections 42, the pervious layer 40 can be covered with a relatively thin layer 44 of aggregate material, such as the aforementioned ballast material, or some other porous layer, for weighting the pervious fabric layer 40 down against the ballast layer 35. As liquid, such as petroleum based fuel oil drips down, say for instance, from a diesel locomotive, it will pass through the grating 42 or the particle weigh down layer 44, and then through the porous fabric filter layer 40 down into the ballast filled reservoir, where the oil drains down to the drain section 20, then by gravity down through passaeway 28 to further passageway 30, where it can drain for instance by gravity to a remote storage facility, to be reclaimed.

While the porous layer 40 will pass liquid, such as the aforementioned oil therethrough, it will not pass material such as sand from the locomotive or train mechanisms passing over the track section 11, and thus any sand or other particles larger than about 70 microns will collect on the top of the filter layer 40, and will not pass into the reservoir. Thus the oil actually feeding through the reservoir into drain portion 20 thereof will not be contaminated by sand, or other fines. Moreover, clogging of the reservoir will be materially delayed or prevented since the liquid will have been filtered by filter layer 40 as well as the ballast layer 35 in the formed reservoir. The thickness of the porous layer 40 can be of any selected thickness, as for instance from approximately 60 mils up to say for instance 190 mils, depending on the thickness of non-woven fabric that is provided in the fabric stock rolls for filter layer 40. However, a thickness of approximately 75 to 90 mils has been found to be satisfactory, and is preferred. In any event, the non-woven fabric material is extremely porous and readily passes liquid therethrough, with the thickness being chosen depending in part on the tear and/or burst strength of the material that the installation may require.

Figures 6, 7:
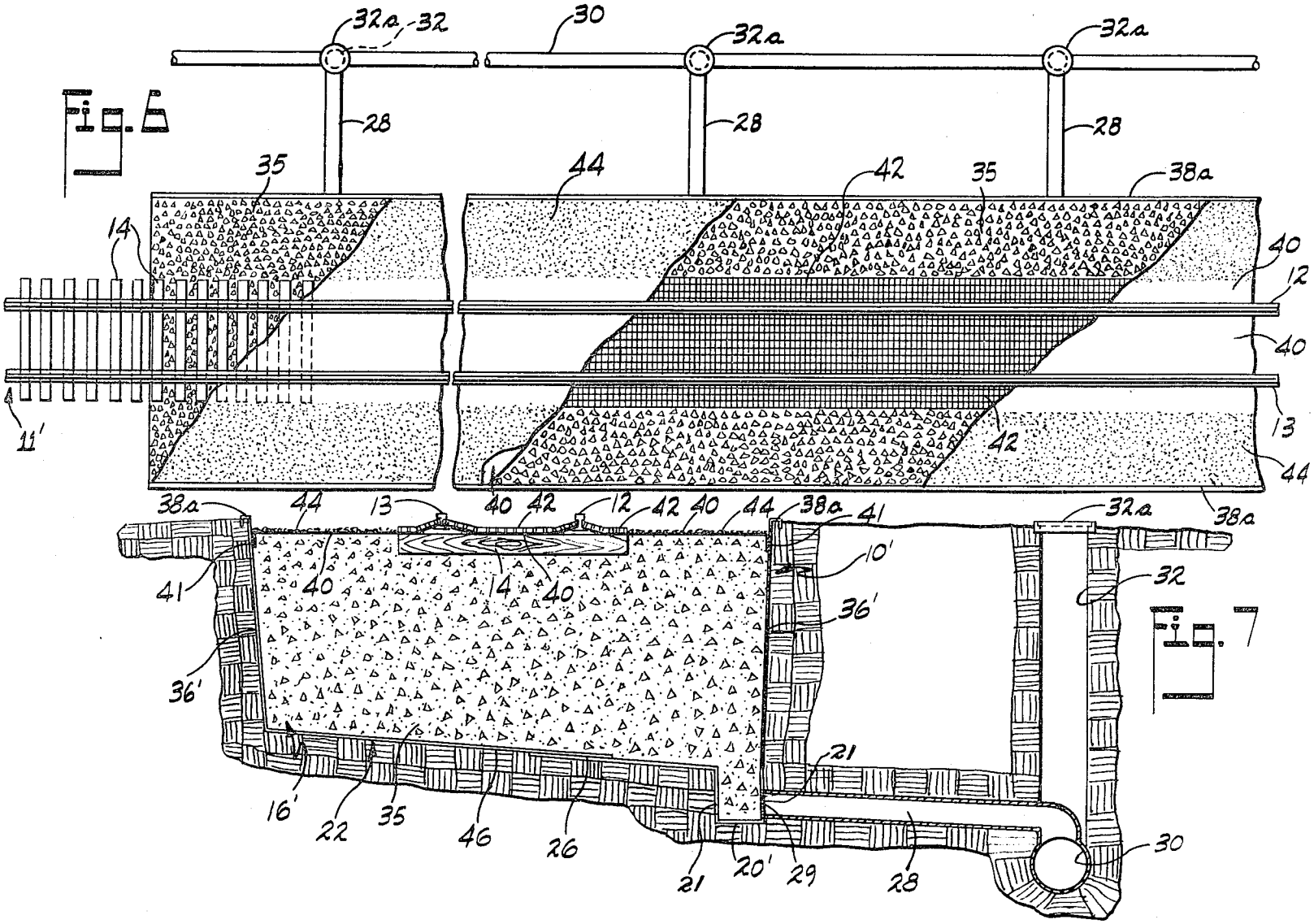
FIG. 6 is a view generally similar to that of FIG. 1, and illustrating another embodiment of containment reservoir in association with a section of railroad track.

Referring now to FIGS. 6 and 7, there is shown a further embodiment of reservoir construction 10' for use with a railroad track section. In this embodiment, the ground containment space 16' has side wall surfaces 36' of a much greater slope as compared to the greater portion of the side wall surfaces of the first described reservoir structure, with the lower drain section 20' of the reservoir being disposed along one lateral side of the reservoir as best shown in FIG. 7. It will be seen that "lapping" of the liner stock occurs as aforementioned in this embodiment, on the bottom wall surface 46 of the reservoir, and with the slope of the bottom wall being such that any possibility of leakage or seepage of the liquid from the reservoir at the adhesively connected overlapping juncture of the liner stock sections is positively eliminated, thus insuring that liquid will run down toward the drain section 20' of the reservoir. This embodiment of reservoir is substantially deeper as compared to the first embodiment.

In other respects, the reservoir embodiment of FIGS. 6 and 7 may be generally similar to that of the first described embodiment with any liquid draining down from railroad vehicles on the track section 11' passing through the grating 42 and/or ballast layer 44, through the pervious upper filter layer 40 down through the ballast layer or bed 35, in the retainer space 16' and down to the drain section 20', where it will flow by gravity through the passageways 28 and 30 whereupon it can be removed.

While a particular type of non-woven pervious fabric material has been identified (and more specifically "Bidim" fabric) as the material for the liner 22 and the filter layer 40, it will be understood that while that is the preferable pervious liner material for the construction of the containment reservoirs of the invention, it may not be the only material having similar characteristics, that would be useable in practicing the invention. The flexible liner 22 of the reservoir aids in distributing the stress from the track section 11 over a wider area, and improves the load bearing characteristics of the soil area in which the reservoir is located.

The method of forming the reservoir and the structure of the reservoir itself results in an economical yet effective reservoir, for catching and reclaiming liquids and preventing their passage into adjacent land areas, thereby preventing introduction of undesirable materials into adjacent land areas and thence into rivers and streams which of course would result in pollution of public waterways.

In laying the filter layer 40 on the top of the reservoir, the width of filter stock can be laid over the tracks (before application of the grating 42 and weight ballast 44) and then a railway vehicle can be brought onto the track section 11 to run over the underlying layer of filter fabric, whereupon the wheels of the vehicle will slice through the fabric and gravity will cause the severed fabric sections to fall in proper position between rails 12 and 13 and laterally thereof, after which the grating 42 and ballast layer 44 can be placed on the too of such severed sections of fabric to weigh the latter down. Grating 42 and ballast layer 44 additionally prevent a slippery condition from existing at the reservoir, since they provide a relatively good footing irrespective of being exposed to the oil caught by the reservoir.

From the foregoing discussion and accompanying drawings it will be seen that the invention provides a novel relatively economical containment reservoir for liquids, such as oil, which comprises a walled containment space opening upwardly, with the space containing a liquid impervious liner generally following the contour thereof, with the liner comprising a layer of pervious fabric material and a layer of liquid impervious material, and with the liner being operable to prevent escape of liquid through the liner from the containment space. The invention also provides a containment reservoir in which means is provided coacting with the lined containment space for facilitating removal of the liquid therefrom, as well as a novel structural arrangement utilizing stock liner material in strip form for readily constructing a liner for any necessary size of reservoir, and facilitating the movement of the materials to the location of use in construction of the reservoir. The invention also provides a novel method of liming an earthen containment space, and a method of collecting liquid from along a railroad track section.

The terms and expressions which have been used are used as terms of description and not of limitation, and there is no intention in the use of such terms and expressions of excluding any equivalents of any of the features shown or described, or portions thereof, and it is recognized that various modifications are possible within the scope of the invention claimed.

What is claimed is:

1. A liquid impervious flexible liner capable of being packaged in roll form and adapted for use in an earthen reservoir for collecting liquid, such as petroleum based oils, consisting essentially of a layer of pervious non-woven polyester fabric material having secured to at least one of its sides a layer of liquid impervious material, the latter being resistant to degradation by petroleum based liquids, said liner being adapted to generally follow the contour of the upwardly opening earthen reservoir space and being adapted to prevent inadvertent escape or seepage of liquid therefrom, the reservoir being adapted to be generally filled with a relatively coarse particle bed, such as for instance, rock or gravel, disposed on said liner, with the bed being adapted to support thereon a section of railroad track for carrying railway vehicles such as diesel powered locomotives, thereon, the first mentioned layer of said liner being needle punched, liquid pervious relatively low density fabric resistant to puncturing and having a thickness in the range of approximately 60 mils to 190 mils, the second mentioned layer being of rubber and having a thickness of approximately one-third the thickness of said first mentioned layer.

2. A liner in accordance with claim 1 which is comprised of plurality of adjoining strips of predetermined width of the first mentioned and second mentioned materials in said secured relation, and overlapped at the junctures thereof, said junctures being secured together thereat to form said liner.

3. A liner in accordance with claim 1 wherein the first mentioned layer possesses a porosity able to hold back particles larger than about 70 microns.

4. A liner in accordance with claim 1 wherein the second mentioned layer consists of nitrile rubber which is applied to the first mentioned layer by calendering.

* * * * *